US007334352B2

(12) United States Patent
Lacey

(10) Patent No.: US 7,334,352 B2
(45) Date of Patent: Feb. 26, 2008

(54) SHOE

(75) Inventor: Brad Lacey, London (GB)

(73) Assignee: Puma Aktiengesellschaft Rudolf Dassler Sport, Herzogenaurach (DE)

( * ) Notice: Subject to any disclaimer, the term of this patent is extended or adjusted under 35 U.S.C. 154(b) by 289 days.

(21) Appl. No.: 10/556,939

(22) PCT Filed: Nov. 28, 2004

(86) PCT No.: PCT/DE2004/002586

§ 371 (c)(1),
(2), (4) Date: Nov. 10, 2005

(87) PCT Pub. No.: WO2005/060781

PCT Pub. Date: Jul. 7, 2005

(65) Prior Publication Data

US 2006/0283044 A1 Dec. 21, 2006

(30) Foreign Application Priority Data

Dec. 23, 2003 (DE) ..... 203 20 091 U

(51) Int. Cl.
*A43B 13/18* (2006.01)

(52) U.S. Cl. ..... 36/28; 36/100; 36/31

(58) Field of Classification Search ..... 36/28, 36/100, 105, 30 R, 35 R, 31, 36 R
See application file for complete search history.

(56) References Cited

U.S. PATENT DOCUMENTS 4,364,188 A 12/1982 Turner et al.
4,573,279 A 3/1986 Feurer-Zogel et al.
4,616,431 A 10/1986 Dassler et al.
4,624,061 A * 11/1986 Wezel et al. ..... 36/30 A
4,680,875 A 7/1987 Danieli et al.
4,937,955 A 7/1990 Bonaventure et al.
5,212,878 A * 5/1993 Burke et al. ..... 36/27
5,410,821 A 5/1995 Hilgendorf et al.
6,023,859 A 2/2000 Burke et al.
6,722,058 B2 * 4/2004 Lucas et al. ..... 36/28
6,880,267 B2 * 4/2005 Smaldone et al. ..... 36/28
6,931,765 B2 * 8/2005 Lucas et al. ..... 36/35 R
2002/0073579 A1 * 6/2002 Lombardino ..... 36/28
2002/0129516 A1 * 9/2002 Lucas et al. ..... 36/35 R (Continued)

FOREIGN PATENT DOCUMENTS

DE 29 04 540 8/1980

(Continued)

*Primary Examiner*—Marie Patterson
(74) *Attorney, Agent, or Firm*—Lucas & Mercanti, LLP

(57) ABSTRACT

The invention relates to a shoe (1), especially a sports shoe, comprising a sole (2) and a shoe upper part (3) linked therewith, the sole (2) having a receptacle (4) in which a damping element (5) is detachably arranged. The aim of the invention is to improve the cushioning and damping behavior of the shoe. According to the Invention, the receptacle (4) substantially or completely extends through the sole (2) at an angle to the longitudinal axis (L) of the shoe (1) and the detachably mounted damping element (5) is constituted of a plate-type base (6) that comprises a plurality of recesses (7) in which damping parts (8) can be disposed. The recesses (7) in the damping element (5) extend across the entire height (H) of the damping element (5) in the vertical direction (V).

20 Claims, 2 Drawing Sheets

U.S. PATENT DOCUMENTS

| | | | | |
|---|---|---|---|---|
| 2003/0208929 | A1* | 11/2003 | Lucas et al. | 36/28 |
| 2004/0068892 | A1* | 4/2004 | Wang | 36/28 |
| 2004/0128860 | A1* | 7/2004 | Smaldone et al. | 36/28 |
| 2004/0181969 | A1* | 9/2004 | Smaldone et al. | 36/28 |
| 2006/0112592 | A1* | 6/2006 | Leedy et al. | 36/29 |
| 2006/0283046 | A1* | 12/2006 | Mason | 36/28 |

FOREIGN PATENT DOCUMENTS

| | | | |
|---|---|---|---|
| DE | 29 22 136 | | 12/1980 |
| DE | 30 29 258 | A1 | 4/1982 |
| DE | 3430845 | | 4/1985 |
| DE | 8808608 | | 12/1988 |
| DE | 3924360 | | 1/1991 |
| DE | 10231882 | | 1/2004 |
| EP | 0146846 | | 7/1985 |
| EP | 0375306 | | 6/1990 |
| EP | 0387505 | | 9/1990 |
| JP | 9-140406 | | 3/1997 |
| WO | WO03 026453 | A2 | 4/2003 |
| WO | WO03 045179 | A2 | 6/2003 |

* cited by examiner

SHOE

The invention relates to a shoe, especially a sports shoe, with a sole and a shoe upper part connected thereto, the sole having a receiving space, in which a damping element can be detachably arranged.

A shoe of this kind is known from DE 102 31 882 A1, for example. The sports shoe described there has a sole, in which a damping system is arranged, which has a spring element. The spring element is designed in the style of a linear slotted spring; it can also be designed as a disk spring or cup spring.

EP 0 387 505 B1 describes a shoe, especially a sports shoe or rehabilitation shoe, with a shoe sole with at least one insert part consisting of a honeycomb body. Insertion of the insert part into a heel wedge of the sole or into another sole part, for example into the intermediate sole, can be carried out from the side by pushing it into a slot or into a corresponding lateral opening. The slot or the lateral opening can be closed toward the outside by a cover plate or with a cover strip. The sole therefore has a receiving space for an insert part, which can be interchangeable. The insert part itself consists of a number of gas-filled honeycomb cells, so that advantageous spring and damping action of the sole is brought about.

Sports shoes, the soles of which are likewise provided with a receiving space in which a damping element can be arranged, are known from DE 29 04 540 A1, DE 29 22 136 A1, DE 30 29 258 A1 and DE 34 30 845 A1. This receiving space is in the form of bores extending horizontally through the sole transversely to the longitudinal axis of the shoe, into which plastic pins of different hardness can be inserted in order to influence the spring and damping characteristics of the sole.

Shoes of a similar kind are known from DE 39 24 360 A1, DE 88 08 608 U1, US 2003/0217483, EP 0 375 306 A2, EP 0 146 846 A1, WO 03/045179 A2, WO 03/026453 A2 and JP 09 140406 A.

In the light of these previously known developments of a shoe, especially a sports shoe, the object of the invention is to improve further the spring and damping action of the shoe and in particular of the shoe sole and to make it adjustable in such a way that the shoe can be equipped with a desired spring and damping action in an optimum way. In this connection, it is to be possible in particular to influence the pronation or supination action of the shoe or the shoe sole specifically and to make it adaptable to individual needs or wishes.

The solution according to the invention for achieving this object is characterized in that the receiving space extends substantially or completely through the sole transversely to the longitudinal axis of the shoe and in that the detachably arranged damping element consists of a basic body of plate-like design, which has a number of recesses in which damping parts can be arranged, the recesses in the damping element extending over the entire height of the damping element in the vertical direction.

By virtue of this, a receiving space for the damping element is produced, into which the damping element can be pushed transversely to the longitudinal axis of the shoe.

In particular, it is proposed that the individual damping parts for arrangement in the recesses are selected in such a way that the shoe or its sole has a desired spring and damping action and/or a desired pronation or supination action.

The invention is therefore based on designing the damping element with a plate shape and providing it with a number of damping parts, the material properties of which are selected in such a way that the spring and damping characteristics of the shoe sole overall but also with regard to the spring stiffness about the longitudinal axis of the shoe can be actively influenced. By influencing the spring stiffness about the longitudinal axis of the shoe, the pronation or supination action of the sole can be specifically influenced and adapted to individual needs.

A development proposes that the receiving space in the sole is arranged in the heel region.

In this connection, the recesses can—seen in the vertical direction—have a hexagonal shape. Furthermore, the recesses and accordingly the damping parts can—seen at right angles to the vertical direction—have a conical shape.

A preferred development of the invention proposes arranging a central recess for receiving a central damping part in the damping element and providing a number of further recesses, in particular six, for receiving further damping parts around the central recess, the further recesses being arranged on a circular path around the center of the central recess. In this connection, the further recesses are preferably arranged equidistantly over the circumference of the circular path.

The height of the basic body—measured in the vertical direction—is preferably between 0.3 and 2.0 cm, in particular between 0.5 and 1.0 cm.

The basic body and/or the damping parts are advantageously made of plastic, in particular of thermoplastic material; in this connection, polyamide, polyurethane, polyethylene, polypropylene, polybutane, polyolefin, ethylene-vinylacetate, polyvinyl chloride or a mixture of at least two of these plastics is preferably provided. In this connection, the plastic material is foamed according to a development.

The material of the basic body and/or of the damping parts preferably has a greater hardness than the material of the sole. In this connection, the plastic of the basic body and the damping parts can have a Shore hardness of between 25A and 45A. In particular, the plastic of the basic body has a lower hardness than that of the damping parts.

To improve verification of the adjusted spring and damping characteristic, the material of the sole is translucent or transparent in the region of the basic body and/or of the damping parts.

In order that the damping element is secured in mounted position, a retaining element can furthermore be provided, which fixes the basic body in its position of being arranged in the receiving space. The retaining element can be of stirrup-shaped design and grip around the sole from below. Both the sole and the basic body can have recesses for positive interaction with the retaining element.

The sole can consist of an intermediate sole and an outsole connected thereto, and the damping element can be arranged in the intermediate sole.

The shoe according to the invention can comprise a system consisting of a number of damping parts of different hardness provided for optional interchange, which can be arranged in the recesses of the basic body. In this connection, each degree of hardness of the damping part is advantageously assigned a defined color, with which the damping parts are dyed at least on their outer surface. Rapid and simple selection of the desired damping parts can thus take place in order to adapt the shoe to individual needs.

With the development according to the invention of a shoe, especially a sports shoe, it is possible to adapt the spring and damping action of the shoe sole and also the pronation and supination action of the sole to individual needs or requirements. Adaptation can take place rapidly and simply, so that the shoe can be adapted optimally to the desired characteristics.

An illustrative embodiment of the invention is shown in the drawing, in which

Figure 1:
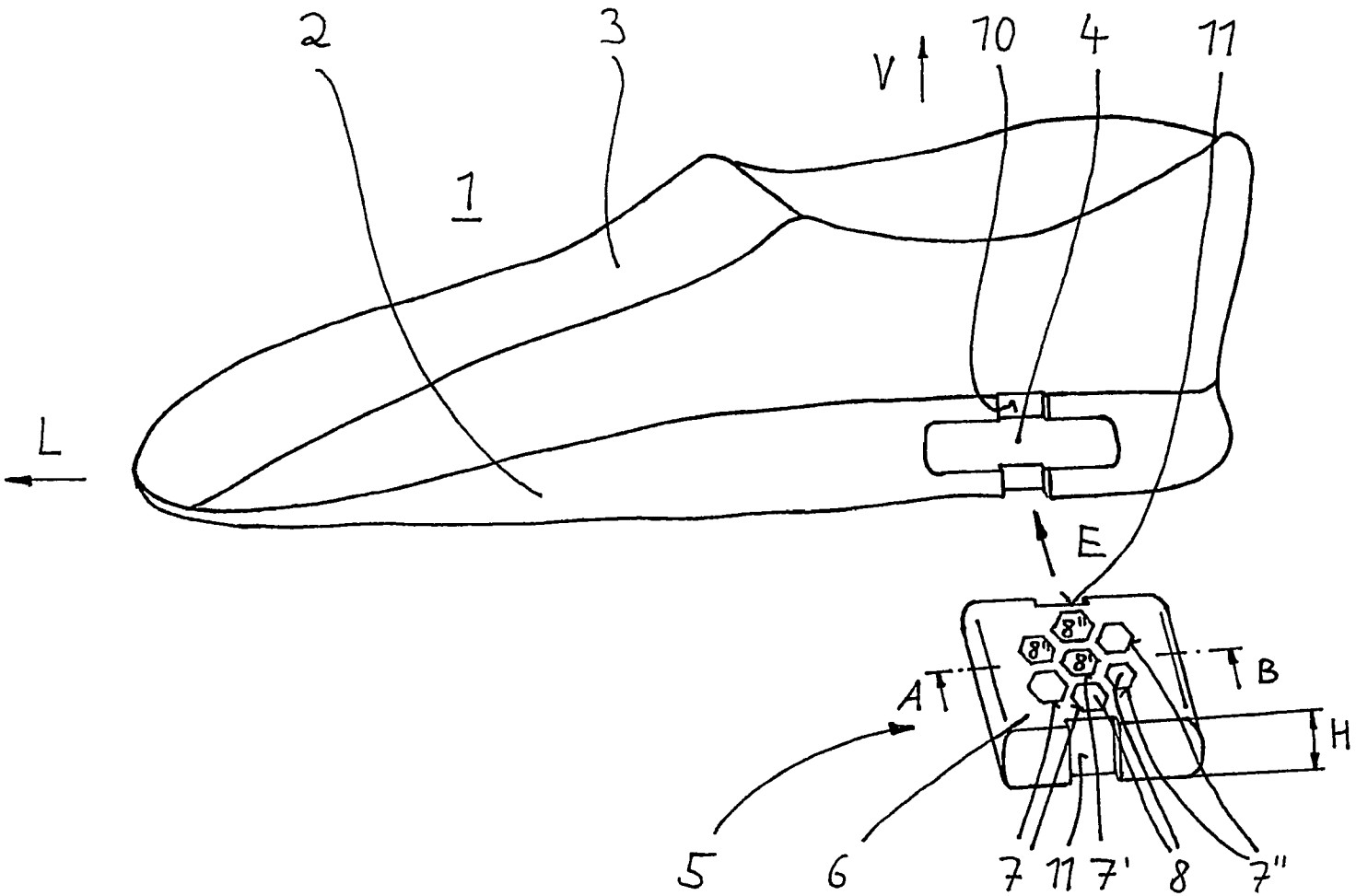
FIG. 1 shows a perspective view of a sports shoe with the damping element removed.

FIG. 1 shows a sketch of a sports shoe 1. The shoe has a sole 2, which is connected in the usual way to a shoe upper part 3. The sole 2 is sketched in one piece. As a rule, however, it consists of a number of part elements, for example of an intermediate sole, on the underside of which an abrasion resistant outsole is arranged.

The sole 2 is provided with a damping element 5 in order for it to be possible to adjust the spring and damping action of the shoe 1 to individual needs. In this connection, the damping element 5 is introduced, that is pushed, into a receiving space 4, which extends over a certain extent along the longitudinal axis L of the shoe 1 and through the sole 2 transversely to this direction. In the illustrative embodiment, the receiving space 4 passes through the sole 2 completely, so that a space extending from the left to the right sole side is brought about. The extent of the receiving space 4 along the longitudinal axis L of the shoe 1 is selected in such a way that the damping element 5 lies between the metatarsus region and heel region.

Figure 2:
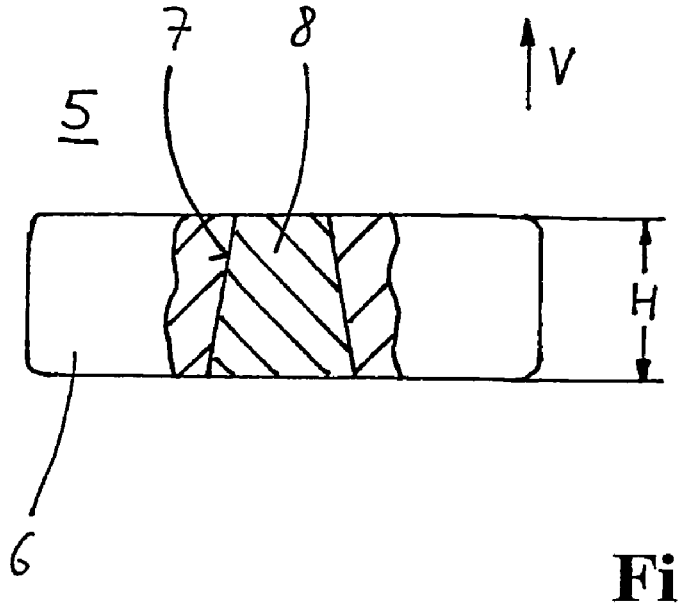
FIG. 2 shows the damping element according to the section A-B (see FIG. 1)
Figure 3:
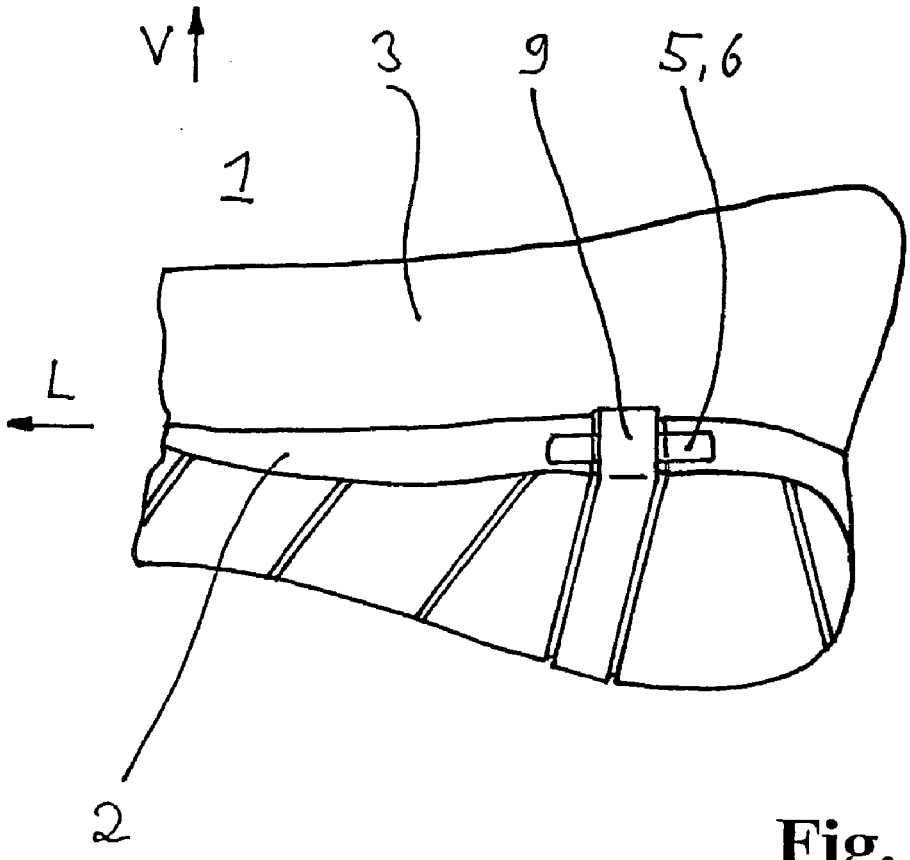
FIG. 3 shows the rear part of the sports shoe illustrated in perspective with the damping element inserted and the retaining element mounted in a view of the shoe from below.

The damping element 5 consists of a basic body 6 of plate-shaped design, which has a number of recesses 7. These extend over the entire height H of the basic body 6 or damping element 5, as can be seen in FIG. 2. Damping parts 8 are in each case inserted into the recesses 7. These damping parts 8 are made of plastic material with the desired hardness and stiffness.

As can be seen in FIG. 1, a central recess 7' is provided in the basic body 6, around which six further recesses 7" are arranged equidistantly on a circular path. Each recess 7, 7', 7" is provided with a damping part 8, 8', 8".

The basic body 6 equipped with damping parts 8, 8', 8" is pushed into the receiving space 4 in the insertion direction E (see FIG. 1). The spring and damping action of the sole 2 is determined by the selection of the material properties of the damping parts 8, 8', 8".

In this connection, it may be mentioned that all the damping parts 8, 8', 8" do not by any means have to be of the same kind. It is possible for the individual damping parts 8, 8', 8", that is both the central damping part 8' and the individual further damping parts 8", in each case to be selected from a "construction kit". It is thus possible for not only the spring and damping characteristic of the sole 2 overall to be adapted to individual wishes but also the pronation and supination action of the sole 2 to be adjusted. If, for example, harder damping parts 8 are used in one lateral region of the basic body 6 than in the other lateral region, a preferential spring deflection is brought about on the sole side with the lower hardness, or elasticity, which has a direct effect on the pronation or supination characteristic of the sole 2.

As can be seen looking at FIGS. 1 and 2 together, the individual damping parts 8, 8', 8"—observed in the direction of the vertical V—can have a hexagonal basic shape but widen conically over the height; the corresponding shape of the recess 7, 7', 7" is formed accordingly.

In order that the damping element 5 cannot come away in its state of being pushed into the sole 2, a retaining element 9 is provided, which is of stirrup-shaped design and grips around the sole 2 from below. The retaining element 9 can be held on the sole 2 by a snap fastener (not illustrated in greater detail), for example.

Both the sole 2 and the basic body 6 of the damping element 5 have recesses 10 and 11 respectively in order to make positive interaction with the retaining element 9 possible. The recess 10 in the sole 2 extends in a groove-like way both in the lateral regions of the sole 2 and in the region facing the ground.

The shoe 1 can be offered as a system to which an appropriate number of damping parts 8 of different hardness and/or elasticity belong. The individual damping parts 8 can be dyed differently depending on their hardness, for example with different shades of gray.

To configure the shoe, the shoe wearer can make an appropriate selection of damping parts 8 with the desired hardness from the system. The damping parts 8 are then inserted into the recesses 7 in the basic body 6, and the damping element 5 thus prepared is pushed into the receiving space 4 and fixed there. The spring and damping action and also the pronation or supination action of the shoe 1 is thus individually set.

LIST OF REFERENCES

1 shoe
2 sole
3 shoe upper part
4 receiving space
5 damping element
6 basic body
7 recess
7' central recess
7" further recess
8 damping part
8' central damping part
8" further damping part
9 retaining element
10 recess
11 recess
L longitudinal axis
H height of damping element
V vertical direction
E insertion direction

The invention claimed is:

1. A shoe (1) with a sole (2) and a shoe upper part (3) connected thereto, the sole (2) having a receiving space (4), in which a damping element (5) is detachably arranged, characterized in that the receiving space (4) extends substantially or completely through the sole (2) transversely to the longitudinal axis (L) of the shoe (1);

the detachably arranged damping element (5) comprises a basic body (6) of plate-like design, which has a number of recesses (7) in which damping parts (8) are arranged, the recesses (7) in the damping element (5) extending over the entire height (H) of the damping element (5) in the vertical direction (V); and a retaining element (9), which fixes the basic body (6) in the receiving space (4), the retaining element (9) being of stirrup-shaped design and gripping around the sole (2) from below.

2. The shoe of claim 1, characterized in that the individual damping parts (8) for arrangement in the recesses (7) are selected in such a way that the shoe (1) or its sole (2) has a desired spring and damping action and/or a desired pronation or supination action.

3. The shoe of claim 1, characterized in that the receiving space (4) in the sole (2) is arranged in the heel region.

4. The shoe of claim 1, characterized in that the recesses (7) have a hexagonal shape seen in the vertical direction (V).

5. The shoe of claim 1, characterized in that the recesses (7) and accordingly the damping parts (8) have a conical shape seen at right angles to the vertical direction (V).

6. The shoe of claim 1, characterized in that the central recess (7') for receiving a central damping part (8') is arranged in the damping element (5) and a number of further recesses (7"), for receiving further damping parts (8") are arranged around the central recess (7'), the further recesses (7") being arranged on a circular path around the center of the central recess (7').

7. The shoe of claim 6, characterized in that there are six further recesses (7").

8. The shoe of claim 6, characterized in that the further recess (7") are arranged equidistantly over the circumference of the circular path.

9. The shoe of claim 1, characterized in that the height (H) of the basic body (6) in the vertical direction (V) is between 0.3 and 2.0 cm.

10. The shoe of claim 1, characterized in that the basic body (6) and/or the damping parts (8) are made of plastic.

11. The shoe of claim 10, characterized in that the basic body (6) and/or of the damping parts (8) is made of foamed plastic.

12. The shoe of claim 10, characterized in that the material of the basic body (6) and/or of the damping parts (8) has a greater hardness than the material of the sole (2).

13. The shoe of claim 12, characterized in that the plastic of the basic body (6) and/or of the damping parts (8) has a Shore hardness of between 25A and 45A.

14. The shoe of claim 13, characterized in that the plastic of the basic body (6) has a lower hardness than the plastic of the damping parts (8).

15. The shoe of claim 10, characterized in that the material of the sole (2) is translucent or transparent in the region of the basic body (6) and/or of the damping parts (8).

16. The shoe of claim 10, characterized in that the plastic is a polyamide, a polyurethane, a polyethylene, a polypropylene, a polybutane, a polyolefin, a ethylene-vinylacetate polymer, a polyvinyl chloride or a mixture of two or more plastics.

17. The shoe of claim 1, characterized in that both the sole (2) and the basic body (6) have recesses (10, 11) for positive interaction with the retaining element (9).

18. The shoe of claim 1, characterized in that the sole (2) comprises an intermediate sole and an outsole connected thereto, and the damping element (5) is arranged in the intermediate sole.

19. The sole of claim 1, characterized by a system comprising a number of damping parts (8) of different hardness provided for optional interchange, which can be arranged in the recesses (7) of the basic body (6).

20. The shoe of claim 19, characterized in that each degree of hardness of the damping part (8) is assigned a defined color, with which the damping parts (8) are dyed at least on their outer surface.

* * * * *